United States Patent [19]

Hanson et al.

[11] Patent Number: 4,929,224

[45] **Date of Patent: * May 29, 1990**

[54] PLASTIC BAG FORMING MACHINE

[75] Inventors: Violet Hanson, P.O. Box 163, Plainview, N.Y. 11803; Ralph Johnson, Ridge, N.Y.

[73] Assignee: Violet Hanson, Plainview, N.Y.

[ * ] Notice: The portion of the term of this patent subsequent to Jan. 9, 2007 has been disclaimed.

[21] Appl. No.: 202,695

[22] Filed: Jun. 3, 1988

Related U.S. Application Data

[63] Continuation-in-part of Ser. No. 687,859, Dec. 31, 1984.

[51] Int. Cl.[5] ..... B31B 33/14

[52] U.S. Cl. ..... 493/194; 493/196

[58] Field of Search ..... 493/194, 196, 244, 245, 493/250, 252, 253, 22, 23, 195

[56] References Cited

U.S. PATENT DOCUMENTS 3,988,970 11/1976 Hanson et al. ..... 493/194

4,230,030 10/1980 Hanson et al. ..... 493/194

*Primary Examiner*—Frederick R. Schmidt

*Assistant Examiner*—Jack W. Lavinder

*Attorney, Agent, or Firm*—Bauer & Schaffer

[57] ABSTRACT

A method and apparatus for the automatic manufacture of flat bottom bags from a substantially continuous supply of a sealable material whereby the material is formed as a bag having a reinforced sealed flat bottom formed by an interior bag forming assembly that is cooperable with a relatively movable folder assembly that folds the bottom of the bag and removes it from the bag former assembly after a length of the bag is severed from the remainder of the material.

23 Claims, 13 Drawing Sheets

PLASTIC BAG FORMING MACHINE

RELATED APPLICATION

This application is a Continuation-in-Part of Ser. No. 687,859 filed December 31, 1984, for which all legal and equitable rights are claimed.

Additional subject matter contained in this application is contained in Disclosure Document 179780 filed October 26, 1987.

BACKGROUND OF THE INVENTION

The present invention relates to a method and apparatus for the high speed manufacture of folded reinforced flat bottom bags of the type disclosed in U.S. Pat. No. 3,970,241.

SUMMARY OF THE INVENTION

In U.S. Pat. No. 4,230,030 there is disclosed an apparatus and method for manufacturing the reinforced flat bottom bag. The present invention is an improvement upon such prior disclosed method and apparatus in that it teaches a method and apparatus by which the same bags may be manufactured in a rapid production manner inexpensively and finished in a folded condition with a more precise arrangement of constructural details that enable the manufacture of bags that are stronger than heretofore made and more attractive in appearance.

In the manufacture of the reinforced flat bottom bags, the bottom of the bag is creased and flattened with greater precision and sharpness to produce folds and seals of greater strength than capable of being made heretofore. The present invention is an improvement upon such prior patented disclosures in that it teaches for the first time, a method and apparatus that uses a forming assembly that shapes the flat bottom bag over substantially its whole planar extent by cooperating with a folder assembly that clamps the bag bottom between them. The cooperation between the former assembly and the folder assembly produces a reinforcing seal of greater strength and extent and further serves to flatten the bottom of the bag into a stronger and more attractive appearance.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings wherein:

DETAILED DESCRIPTION OF THE PREFERRED EMBODIMENT

Figure 1:
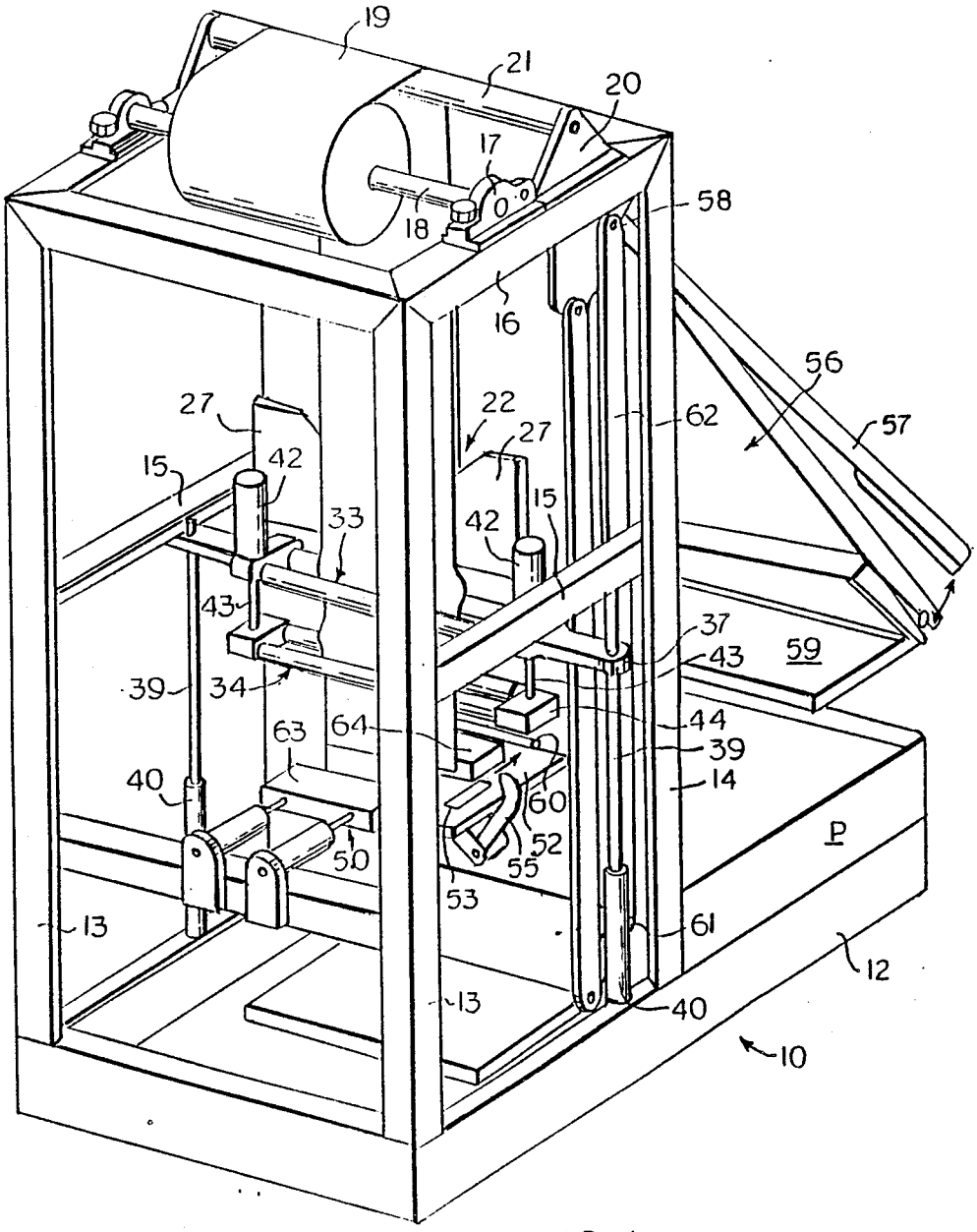
FIG. 1 is a perspective view of a machine for manufacturing folded flat bottom bags constructed according to the present invention.
Figure 2:
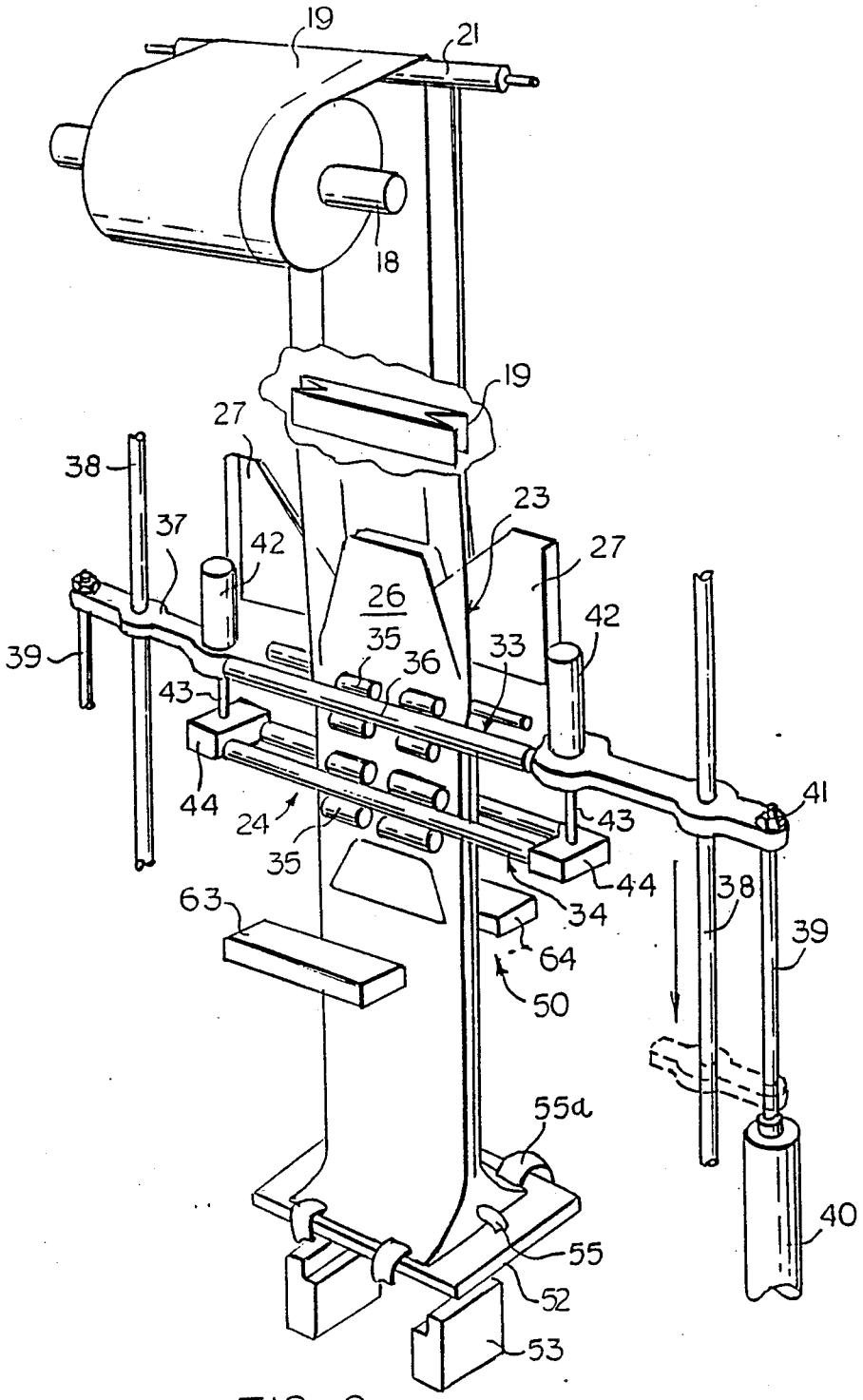
FIG. 2 is an exploded elevational and schematic view of the machine of FIG. 1.

Referring to the drawings and more particularly to FIGS. 1 and 2, the apparatus there shown is generally identified by the numeral 10. It depicts a machine for making and folding reinforced flat bottom bags, such as bags of the type substantially as disclosed in U.S. Letters Pat. No. 3,970,241. The apparatus or machine 10 for making and folding flat bottom bags requires a relatively small floor area because it is disposed generally vertically, extending upwardly from a base 12. The frame of the apparatus 10 includes a pair of front corner posts 13, corner posts 14 intermediate cross-bars 15, header beams 16.

Integral with the header beam 16 are a pair of pillow blocks 17 providing a journal for a rod 18 on which is a freely rotatably held supply roll of heat sealable material 19 from which the flat bottom bags are to be formed. The supply roll of bag forming material 19 is substantially continuous in length and may be supplied in the form of a closed sleeve. It is not unusual for manufactures of such rolls of closed sleeve plastic material to supply the same with flat faces and inwardly gussetted sides as seen in FIG. 2. Hence, it is possible to utilize a supply of material 19 that has a sleeve shape and that may or may not be pregussetted to eliminate the need to form such gussets at a later time in the present bag forming machine 10. The supply roll of bag forming material 19 may be of a heat sealable plastic material.

Although it is not necessary that the sides or faces of the machine or apparatus 10 need be denominated as such, it is convenient for purposes of description that the space between the front posts 13 be denominated as the front and that the space between the rear posts 14 be referred to as the rear, while the front to rear spaces between the posts 13 and 14 on each side be referred to as the sides left and right, respectively as seen in FIG. 1.

Mounted, also on the header beams 16, is a second pair of pillow blocks 20 in which is journalled an idler roll rod 21. Preferably, the roller rod 21 is located slightly to the rear of the center line between the front and rear posts 13 and 14 respectively, so that the bag supply material 19 can roll therein and depend vertically therefrom. In this manner, the bag forming material 19 can be made to freely pass sleeve-like over a bag forming assembly generally depicted by the numeral 22, wherein, in a cyclic and continuous manner, the material is pulled down, its leading section formed into a flat bottomed bag, sealed and removed.

The bag forming assembly 22 as seen more fully in FIG. 2 comprises an upper mandrel generally depicted by the numeral 23 adapted to guide and at the same time pre-open and shape the tubular supply of bag material 19, and a lower mandrel generally depicted by the numeral 24 which is caused to move between a raised inoperative position and a lowered operative position in which the bottom of the completed bag is formed. The upper and lower mandrel sections are mounted on opposite sides of a central post 25, the upper mandrel section 23 being non-movable, while the lower mandrel section 24 is raiseable and lowerable as will be seen hereinafter.

Figure 3C:
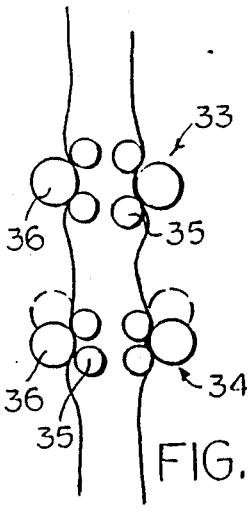
FIG. 3, 3*a* 3*b*, 3*c*, and 3*d*, are schematic views of the mandrel for forming the bag as used in the present invention.
Figure 3B:
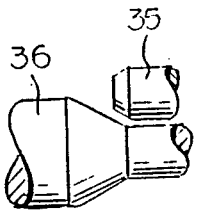
Figure 3:
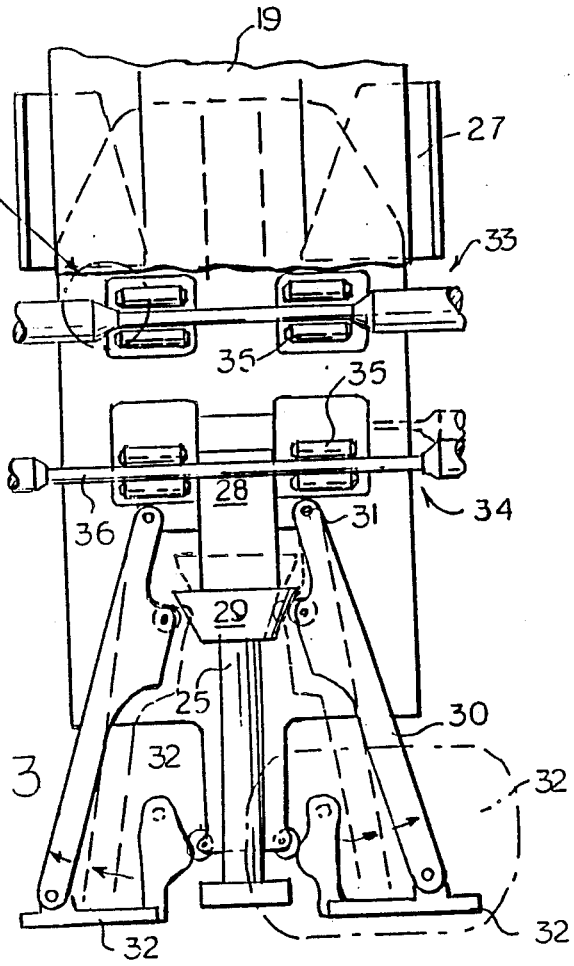
Figure 3D:
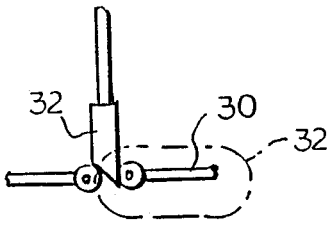

The upper mandrel section 23 as seen in FIGS. 2 and 3 includes a pair of flat plates 26 hinged to the center post 25, generally parallel to the central plane of the vertically depending bag material 19. The plates 26 are slightly sprung outward along their lower edges to cause the bag material to correspondingly spread out. Mounted in the plane of the vertically depending bag material 19 to either side of the material are a pair of gusset plates 27 adapted to enter into the gussets of the bag and thus stabilize the bag material as the flat plates 26 spring the material outward.

Figure 3A:
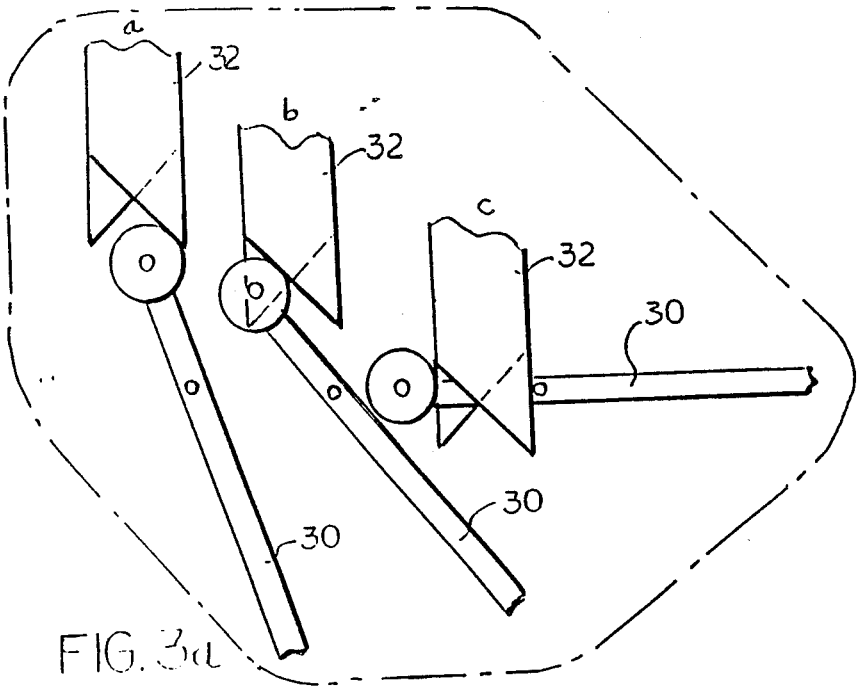

The lower mandrel section comprises a sleeve 28 slidably mounted over the central post 25. Fixed on the sleeve 28 is a collar 29 against which a pair of lateral extending arms 30 hinged at their upper end 31 movably slide. At the lowered end of each of the arms 29 there is pivotably mounted a rectangular plate 32. As the collar 29 is caused to be raised or lowered relative to the center post 25 by movement, the arms 30 cause the plates 32 to move between a vertical inoperative position shown in dotted lines, the horizontal operative position shown in full lines and extending perpendicular to the plane of the drawing paper (FIG. 3*a*) by which it fully stretches the bag outward transverse to its width to form the partial completely flat bottom.

Serving to raise and lower movable section 24 of the mandrel and simultaneous pull or draw down the bag forming material 19 are an upper roller system, generally depicted by the numeral 33 and a lower roller system generally depicted by the numeral 34. Each roller set 33 and 34 comprises two pairs of inner rollers 35 and a pair of outer rollers 36 so that the flat sides of the bag material 19 is capable of being threaded therebetween as seen in the FIGS. 2 and 3*c* so as to be firmly held for the bag forming process yet being capable of being pulled down through the upper roller set 33 by the lower roller set 34.

As seen in FIGS. 1 and 2, the rollers 35 and 36 of the upper roller set 33 are journalled on a transverse carriage 37 slideably guided over a pair of vertical rods 38 respectively fixed fixed between the base 12 and header beam 16 on the left and right side of the apparatus. The carriage 37 is fixed at each of its ends on a piston rod 39 actuable by a hydraulic or pneumatic cylinder 40. The transverse carriage 37 is adapted to be raised and lowered by the hydraulic (or pneumatic) cylinder 40 fixed at one end on the base 12. The piston rod 39 is secured by a bolt 41 to the carriage 37. Although two such piston cylinder arrangements are shown, only one may be really essential and thus used.

The lower roller set 34 is connected to the carriage 37 for relative movement therewith, by a second set of hydraulic (pneumatic) cylinders 42 and extending piston rods 43. The piston rods 43 are each fixed to a box journal 44 to which only the outer rollers 36 of the lower roller set 34 are journalled. The inner set of rollers 35 are fixed to the sleeve 28, to be conjointly moveable along the post 25.

It will thus be apparent that the entire lower section of the mandrel assembly 24 including the upper rollers 33 and the lower rollers 34 is movable by actuation of the cylinders 39 while the lower roller section 34 is movable relative to the upper roller section 33 by independent actution of the cylinders 42. Operation of the cylinder 40 and 42 in timed cylindrical sequence can be readily effected by known techniques combining suitable connection to a source of hydraulic or pneumatic fluid from the source to the cylinders and in return, as well as timers, relays and the like, to effect the necessary sequence. Such known techniques may be conventionally adopted here.

By lowering the entire mandrel assembly 24, the roller sets 33 and 34 pull down the bag material 19 from the supply roll. The degree of pull-down can be varied by modifying the piston strokes of actuator 40 and 42 and, thus, the ultimate size of the bag determined. Further, by separate and independent lowering of the lower roller assembly 24, the sleeve 28 on which the collar 29 is fixed, will cause the hinged arms 30 and plate 32 shown in FIG. 3, to flair outwardly into the horizontal position to thereby open the bag material and initiate the formation the flat bottom.

Figure 4:
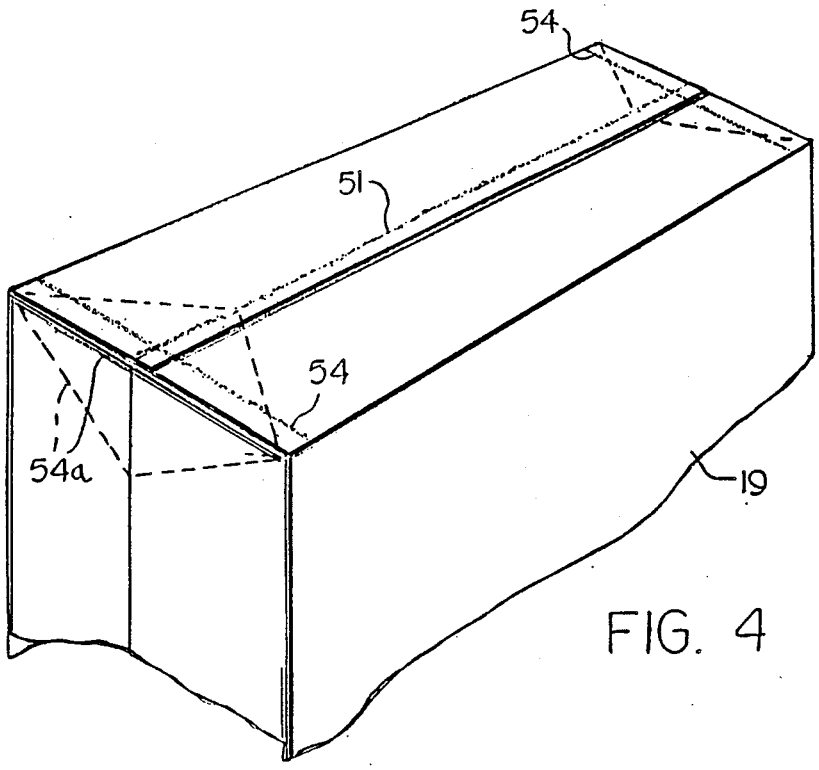
FIG. 4, and 4*a* are views of the bag bottom showing the sealing seams thereof.
Figure 4A:
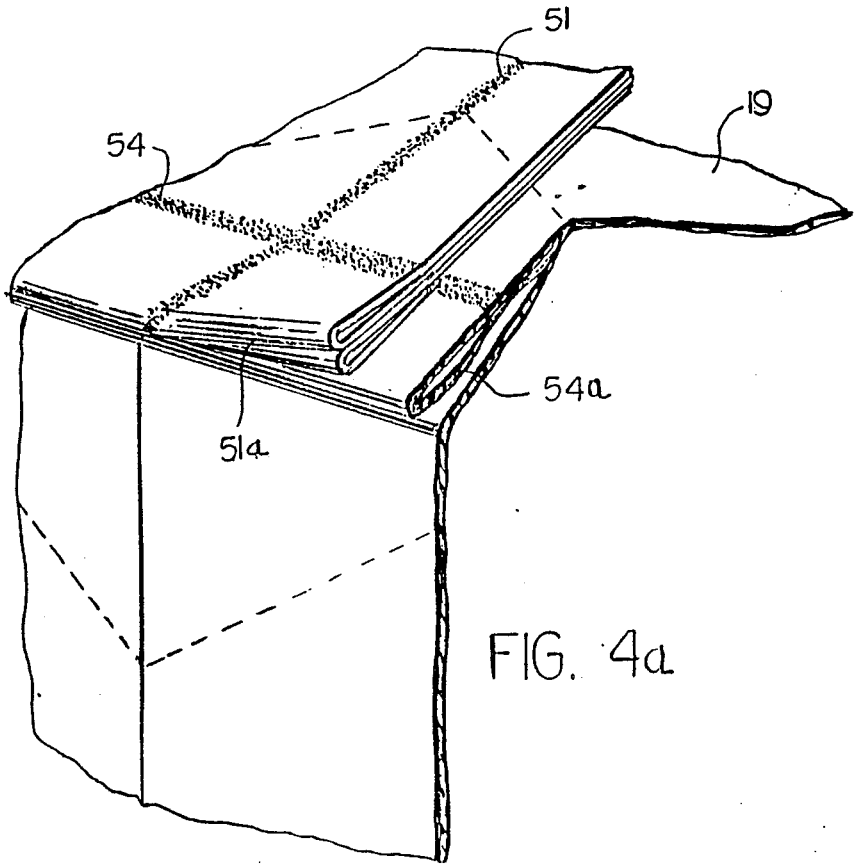

Located at a position below the lower mandrel assembly 24 and above the extreme position wherein the mandrel mechanism may be lowered by actuation of both cylinders 40 and 42 is a heat sealer and cutter mechanism 50. Prior to the flairing of the bag by operation of cylinders 40 and 42 and the mechanism shown in FIG. 3, this sealer and cutter mechanism 50 is caused to be operated to form as seen in FIG. 4*a* and 4*b*, a transverse seal 51 in the bag material 19 and to cut any preceding excess material or precedingly formed bag from the supply material. The transverse seam 51 thus closes the supply material 19 just below the plates 32 prior to forming the flat bottom, so that upon further movement of the lower roller assembly 24, the plates 32 push against the closed bottom.

Figure 18:
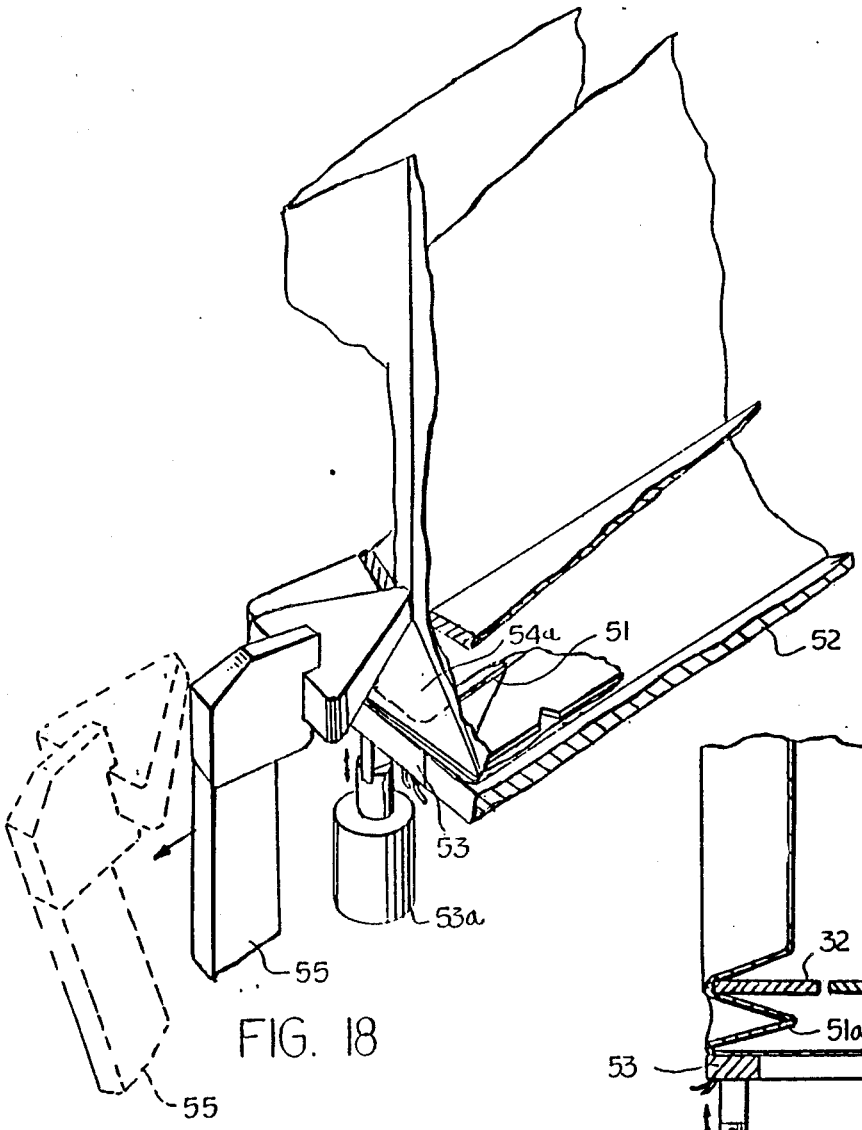
FIG. 18 is a perspective view partially in section showing details of the platform for completion of the bag bottom.
Figure 19:
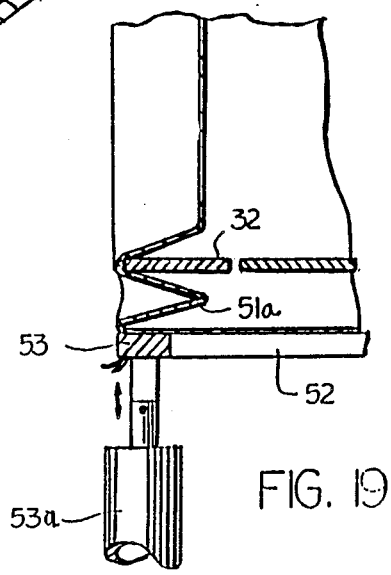
FIG. 19 is a sectional view, head-on, of the end of the platform.

It is this closure of the bag material that, in fact, the cylinders 40 and 42 are sequentially operated. Because the bag is thus sealed, the plates 32 of the movable mandrel section causes the material not only to flair but also to move further downwardly. Spaced below the sealer cutter assembly 50 by a distance equal to the distance of the ultimate bag height is a platform 52 against which the flaired mandrel plates 32 push the closed end of the bag material, producing folded portions 51*a*. As the bag material, already sealed along seam 51, is pushed by the extending plates 32 against the platform 52, the sealed end is folded over against the platform 52 as seen in FIG. 19. The reinforced flat bottom of the bag is then completed as shown in FIG. 4*b*. The platform 52, as seen more clearly in FIGS. 18 and 19, is provided with a pair of electrical heating elements 53, one on each side, extending transversely to the closing seal 51. The electrical heating elements 53 are mounted on the end of a piston/cylinder 53*a* and is moveable up into engagement with the folded bottom to further tack the folded portions 51*a* of the flat bottom together with a pair of side seam 54. Simultaneously, a pair of gusset retention members 55, pivotably mounted adjacent the platform 52, move inwardly into the gusset, causing the gusset flap 54*a* to fold inwardly, to be sealed also by seam 54 to the reinforced bottom of the bag (FIG. 4).

In this manner, the bag is completed. Immediately thereafter, the completed bag is released at its upper end from the material supply 19 by activation of the sealer/-cutter mechanism 50, which not only severs the bag which has been completed, but simultaneously forms the closure seal 51 for the next succeeding bag.

Figure 12:
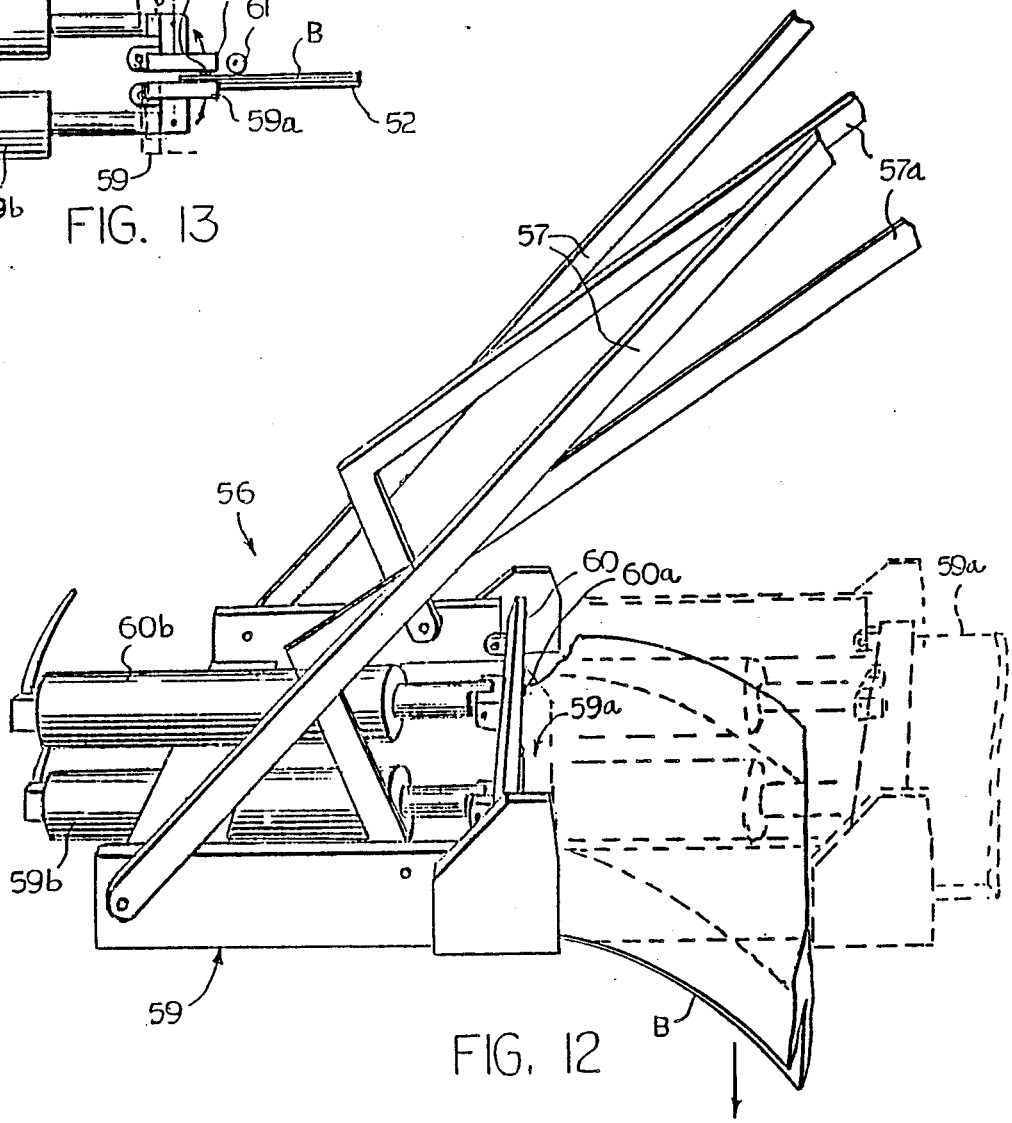

The completed bag B is removed from the platform 52 by an ejector assembly generally depicted by numeral 56 shown in FIG. 1 and in detail in FIG. 12, comprising two pair of articulated arms 57 and 57*a* pivoted at their upper ends 58 to a header beam 16 and depending downward at the rear of the frame. The ejector assembly 56 is provided with a frame 59 having a pivotable bottom plate 59*a* extending forwardly and adapted to enter below the flat bottom bag remaining on the platform 52, and an upper plate 60 pivotally mounted on the frame 59 which closes jaw-like over on the flat bottom plate 59*a*. The completed bag bottom lying flat against the plate 52 is thereby capable of being grasped between plates 59*a* and 60 which thus flattens due to the action of the plates 59*a* and 60. Rubber gripping bumpers are located on the upper plate 60 to insure holding of the bag. The plates 59*a* and 60 are pivoted by operation of hydraulic or pneumatic actuators 59*b* and 60*b* respectively. The arms 57 are then swung outwardly from the machine frame carrying with it the bag, which then slides in the direction of the arrow between the plate 52 and a roller 61 (FIG. 1) to flatten itself as it is withdrawn. The plates 59*a* and 60 are then opened allowing bag to be then stacked one on top of the other on a pallet P to the rear of the frame. Because the arms 57 and 57*a*, the frame 59 and the header 16 make an articulated quadrilateral, the frame 59 remains horizontal during its entire movement.

Figure 11:
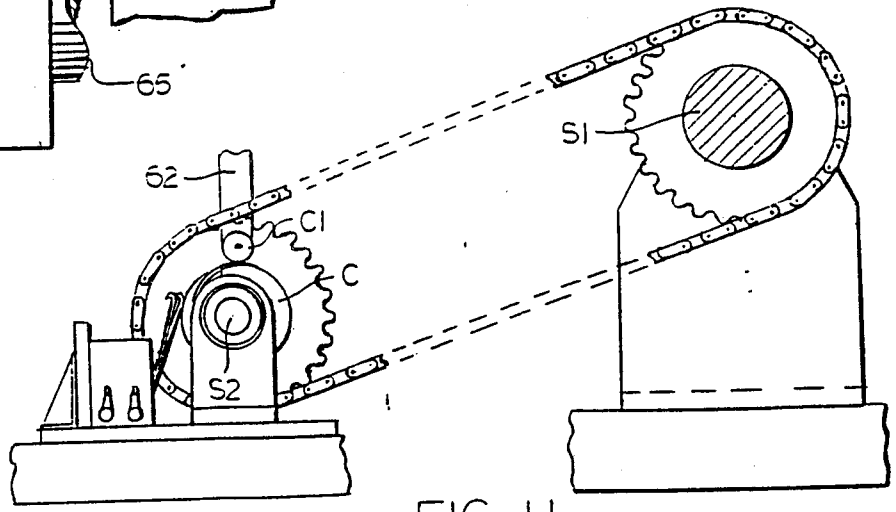
FIG. 11 is side elevational view of the device and cam transmission used in the present invention.

The ejector assembly is actuated via vertical lever arm 62 extending from the upper end of the ejector arm 37 to the base 12 where it is provided as seen in FIG. 11 with a cam follower C1 riding on a cam C rotatable by connection to a power transmission shaft S connected to a motor M. The cam C also functions to operate several micro switches capable of regulating the function of the solenoids and valves operating the actuators 59*b* and 60*b* respectively.

Figure 5:
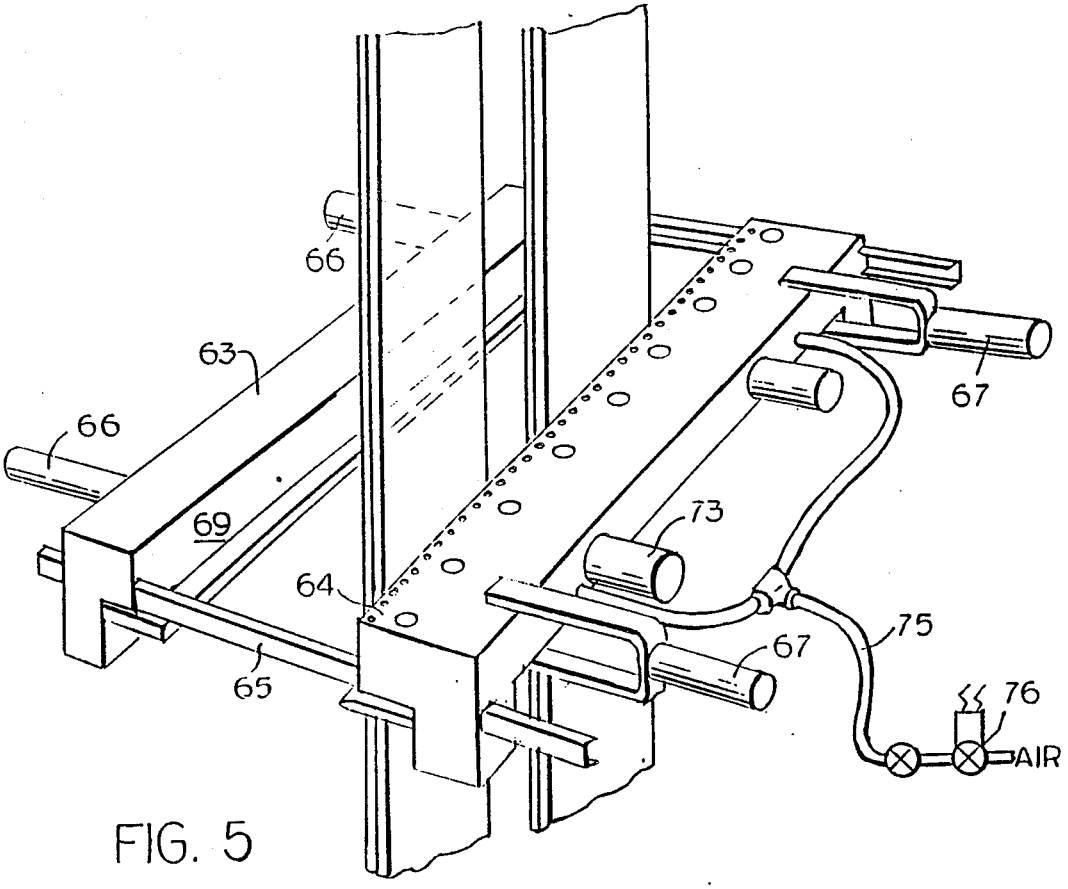
FIG. 5 is a partial perspective view of the details of the bag sealing and cutting mechanism used in the present invention.
Figure 6:
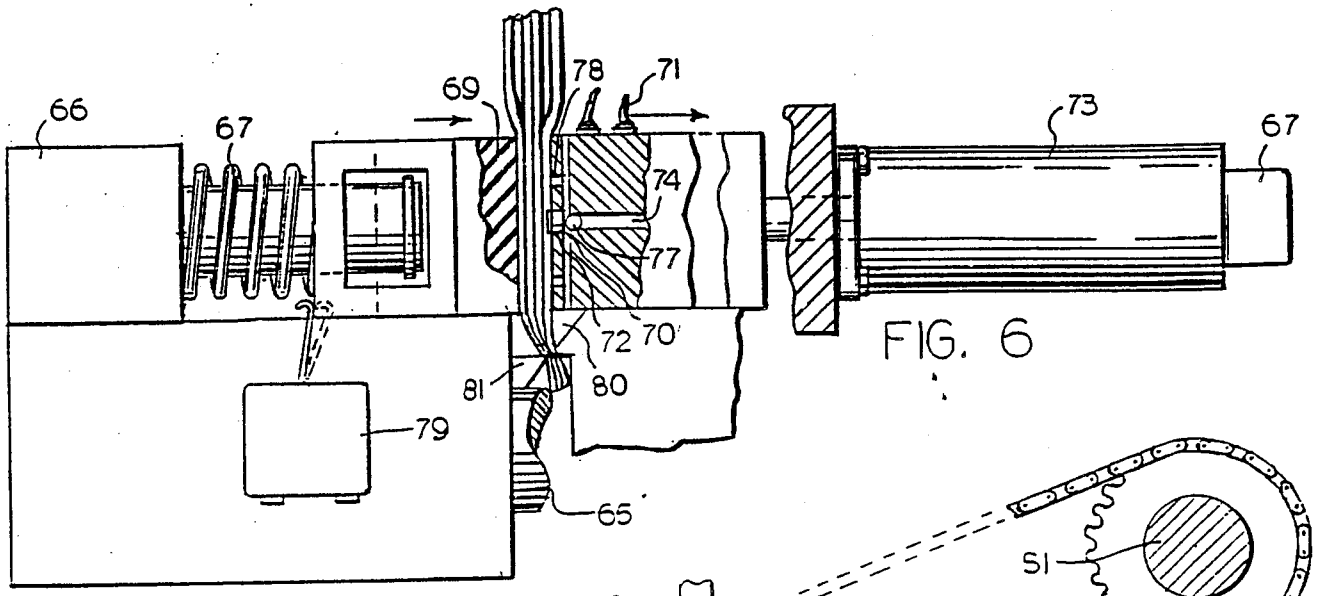
FIG. 6 is a side elevation, partially sectioned, of the mechanism shown in FIG. 5.

The heat sealer and cutter mechanism 50 as seen in detail in FIGS. 5 and 6 comprises a back-up assembly 63 and a heater assembly 64. Both of these assemblies are mounted on side support rails 65 (or cylindrical bars) fastened to the machine frame so as to be easily slideable inwardly and outwardly relative to each other on either side of the plane of the bag material 19 (see FIGS. 1 and 2). Each of the back-up assembly 63 and heater assembly 64 are actuated by piston cylinder actuators 66 and 67 respectively, the cylinders being fixed to the frame of the housing on opposite sides of the machine frame. Each of the cylinders are provided with a return spring 68 (FIG. 6) to insure immediate return of the associated piston upon release of the cylinder actuation. While each of the assemblies 63 and 64 are shown here with two actuators, it will be clear from the later description, that only one may be necessary. Both the back-up assembly 63 and the heater assembly 64 are formed of rectalinear box-like hollow members. The back-up assembly 63 is provided with a hard rubber face 69 to dampen the shock when it meets and abuts the heater assembly 64, and to resiliently squeeze the folded bag material together. The heater assembly 64 contains one or more heating elements 70 (FIG. 6) arranged along the length of the face thereof connected in a conventional manner through terminal 71 to a source of electrical current. Preferably the heating elements 70 are mounted on or are constituted by elongated bar 72. In any event, they are reciprocable perpendicularly to the plane of the face so that the elements may be moved into and out of engagement with the faces of the bag material, independent of the movement of the back-up member 63 or the heater assembly 64 as a whole. The heater elements 70 or the bar 72 as a whole, is moveable by hydraulic or pneumatic piston cylinder actuators 73, the cylinder being mounted on the heater assembly 64 and the piston passing into and through the heater assembly 64.

Passing through the heater assembly 64 from the rear toward the front, are a plurality of air lines 74 (FIG. 5) connected by a manifold (not shown) via one or more air lines 75 to a source of air, preferably under pressure, regulated by one or more valves 76 (FIG. 5). The air holes 74 communicate with vertical air holes 77 (FIG. 6) set back from the face of the heater assembly. The vertical air holes 77 are open at each end to the atmosphere. Small bleeder holes 78 may also be made in the face. Application of air into the heater assembly is made simultaneously with the heating operation, as well as before and after the elements are provided with current. In this manner, the face of the heater assembly is constantly cooled; avoiding overheating, burning of the plastic bag material, sticking of the bag material to the heater assembly or the rubber back up pad, or burning of the rubber pad itself. As a result, the closing of the bag can be cycled at a very high rate.

The forward thrust of the back-up member and the heater assembly is sensed by a limit switch 79 which also initiates the cycle return of the heater assembly etc.

Mounted below the forward edge of the heater assembly 64 is a cutter blade 80 having its sharp edge along its lower face. A counter blade 81 is similarly mounted below the forward edge of the back-up member 63. The counter has its sharp edge on its upper face and is adapted to slide below the cutter blade 80. Thus, the plastic bag material can be simultaneously cut and severed from the plastic sheet roll together with the formation of the bottom seam 51 by action of movement of the back-up and heater assemblies 63 and 64.

Figure 7:
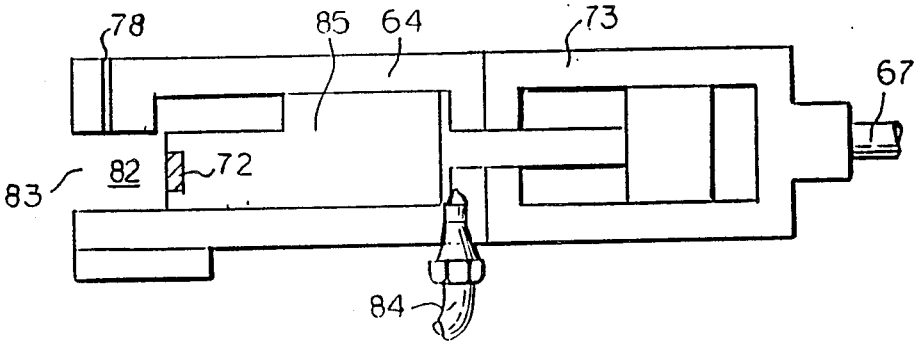
FIG. 7 illustrates schematically, another embodiment of the mechanism.

A modified version of the heater and cutter mechanism is schematically shown in FIG. 7 using the same reference numerals for similarly functioning elements. It this construction, the heater assembly 64 comprises a hollow rectilinear chamber 82 open at its forward face 83, and having vertical bleed holes 78 in its upper wall only. The air is fed via a nozzle 84 directly into the chamber 82. The heater elements 72 are mounted on a solid strip 85 which is actuated by the piston in cylinder 73.

Figure 8:
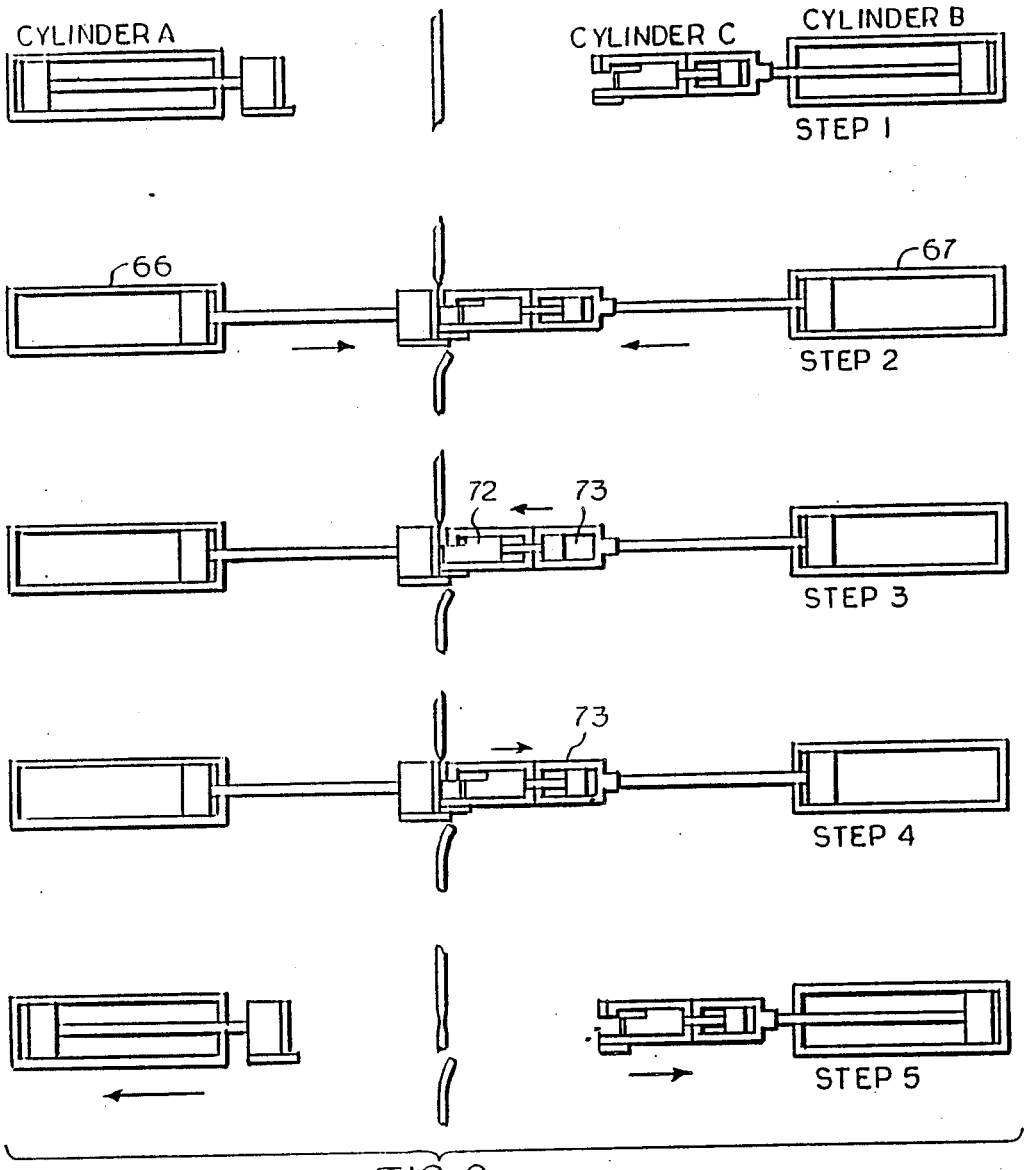
FIG. 8 illustrates the sequence of steps in sealing and cutting the bag.

FIG. 8 illustrates schematically the sequence of five steps necessary to simultaneously heat, seal and sever the completed bag using either embodiment of the heater and cutter mechanism. Step 1 shows the position of the back-up member 63 and the heating assembly 64 at rest. In step 2, the back-up assembly 63 and the heating assembly 64 are moved into abuttment by operation of their actuators 66 and 67 thus clamping the plastic bag material firmly therebetween. Thereafter, in step 3, the actuator 73 is operated causing the heating element 72 to move forwardly and engage the plastic material, thus forming seam In step 4, the heating element 72 is withdrawn followed by step 5 which returns the back-up assembly and heating assembly to the initial rest position, whereupon the plastic material can be pulled down as previously illustrated and described, to form the flat bottom of the sealed and formed bag and at the same time, present the next succeeding bag in placed for sealing.

Figure 9:
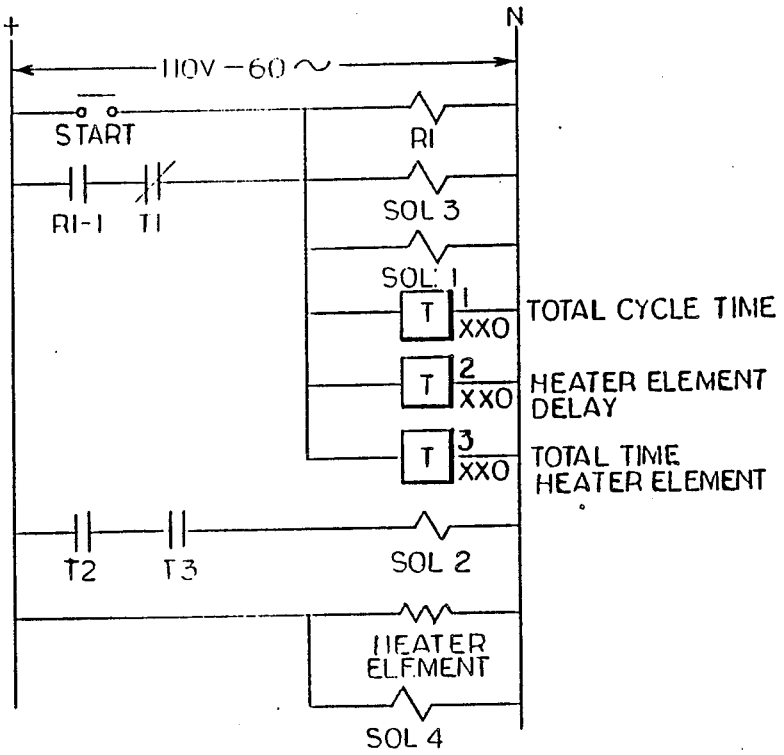
FIGS. 9 and 10 is electrical circuit diagnosis showing the control system for the heating and cutting mechanism.
Figure 10:
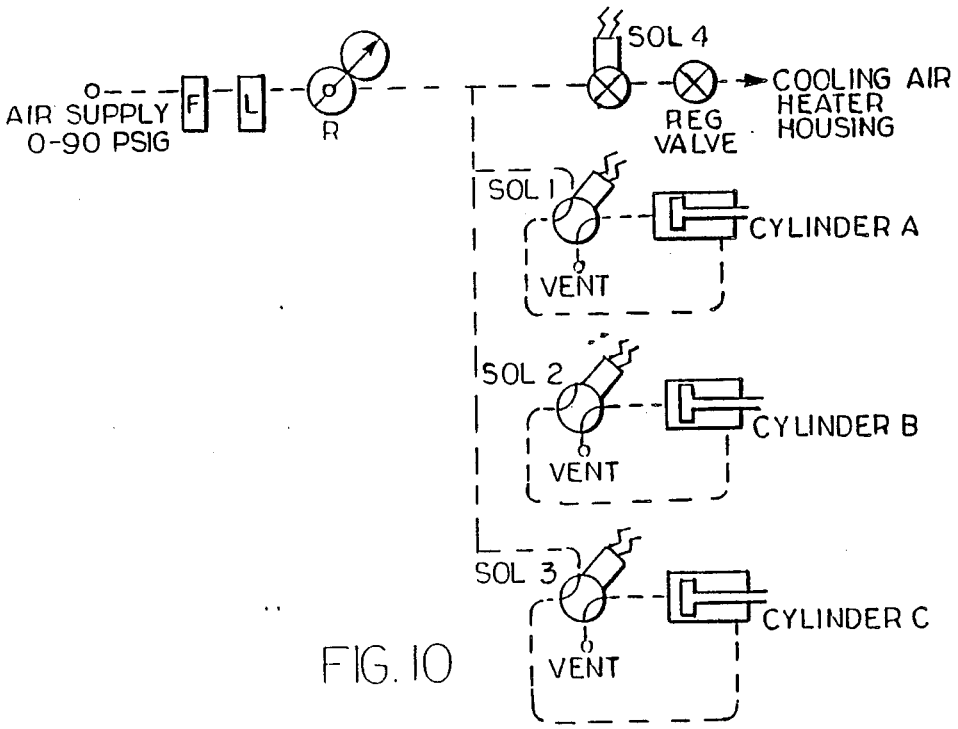
Figure 13:
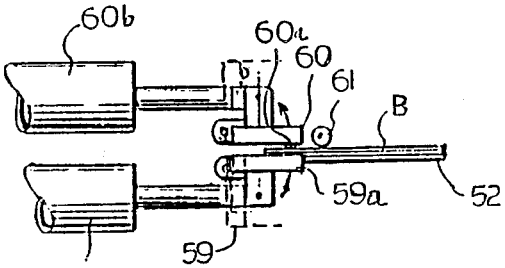
FIGS. 12 and 13 are detailed views of the bag ejector assembly employed to remove the completed bag from the machine.

FIG. 9 and 10 show the electric circuit and hydraulic/pneumatic circuits for accomplishing the steps as shown in FIG. 8 In FIG. 11 the drive motor and belt and cam transmission is illustrated. The cam C and separate micro switches following this cam, are arranged so as to provide for pull down cutting and heating as well as for control of the remaining elements of the machine. During operation the position of the heating and sealing assemblies are such that they are spaced from each other, allowing the bag material to be pulled down between them, and flaired by operation of the lower forming mandrel 24 which also passes within the back-up and heating assemblies 63 and 64. Once the bag bottom is flattened against the platform 52 and the side gusset fingers 55 engage the bag, and edge clamp means 55*a* (FIG. 2) engage the bag bottom, thus holding the bag firmly to allow the lower mandrel 24 and is plates 32 to be raised. Once the lower mandrel is raised, the heater assembly is free to seal the next bag bottom and sever the bag on the platform 52. The two heater cutter elements are then so moved toward each other so as to be in abuttment, and the power is turned on, the heater element and the selenoid valves operating the heating element are actuated, and maximum air is supplied to maintain the temperature of the heating element being regulated by the flow of the air through the air holes. Thereafter, the forming assembly comprising the upper and lower mandrels, are actuated to create the succeeding bag.

The high speed at which the heater apparatus works and the fact that the air flows over the heating strip negates the requirement to use teflon covers or other cover means for the back-up assembly. Both the back-up and the heater assembly move toward the center. The plastic film is immediately cut by the cutting blades and held and squeezed generally between the two assemblies. When the heating element is brough into contact with the gussetted plastic film by the extension of the cylinder, this contact is a very short duration, and with the presure of the cooling air on deactivation of the cylinder, the sealing element is easily withdrawn from the plastic film and does not stick to it.

In the modified apparatus shown in FIGS. 14 to 17, like elements are depicted with the same numerals as heretofore and unless specified, function in the same way.

Figure 14:
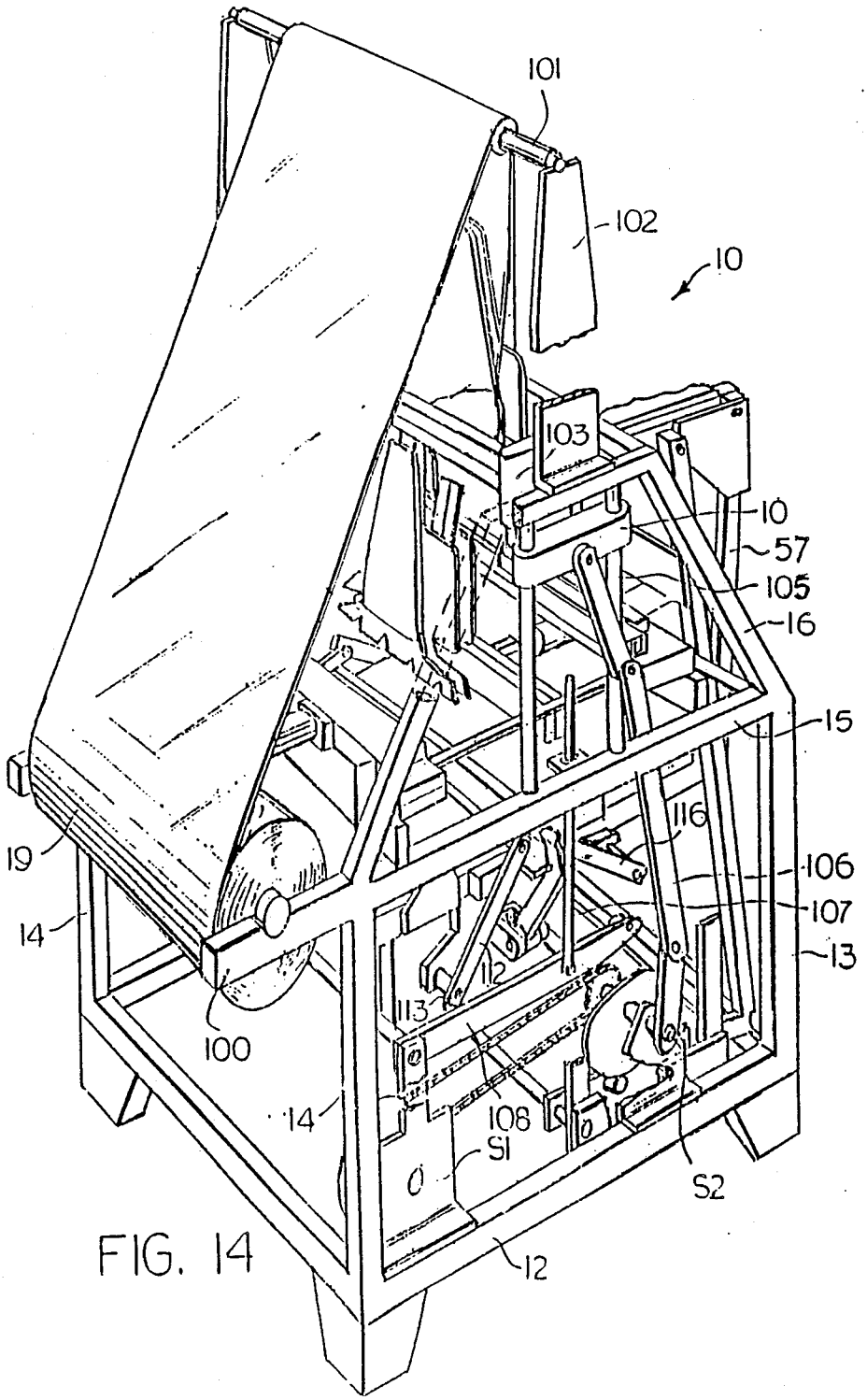
FIG. 14 is a view similar to FIG. 1 showing a modified version of the bag forming apparatus.

Differing from the earlier version, in that of FIG. 14, the material supply roll 18 is mounted on a roller 18 journalled at each end in a reawardly extending bracket arm 100 integral with the cross beam 15. This permits easier loading of new rolls. The headers 16 extend pyramidally upward and the plastic material 19 passes over an idler roller 101 journalled on a vertical standard 102 integrally fixed to the headers 16. The material passes downwardly over the bag forming apparatus 22 which in general, comprises the upper and lower mandrel assemblies 23 and 24 as described earlier. Here, however, the roller sets 33 and 34 are mounted on associated carriage blocks 103 and 104 respectively, on each of the lateral sides of the machine. The lower blocks 104 holding roller sets 34, slides reciprocally on a pair of vertical rods 105 and is actuated to move upwardly and downwardly through an articulated linkage 106 connected to the cam shaft mounted on the base 12, being the cam shaft shown in FIG. 11.

The upper cariage block 103 carrying the roller set 33 rests on the lower carriage block 104, but is slightly off-set inwardly therefrom. In this manner, movement of the lower carriage block 104 conjointly moves the upper carriage block 103. The necessary relative movement between the two roller sets 33 and 34, required to permit the lower mandrel to pull down the plastic bag material, is effected by providing a vertical post 107 beneath the upper carriage block 103. The post 107 is mounted on an adjustable arm 108 so that the upper end 109 of the post 107 can be located and given height to arrest the downward movement of the upper carriage block 103 at a predetermined point thereby permitting only the lower carriage block 104 to move further downwardly.

Figure 15:
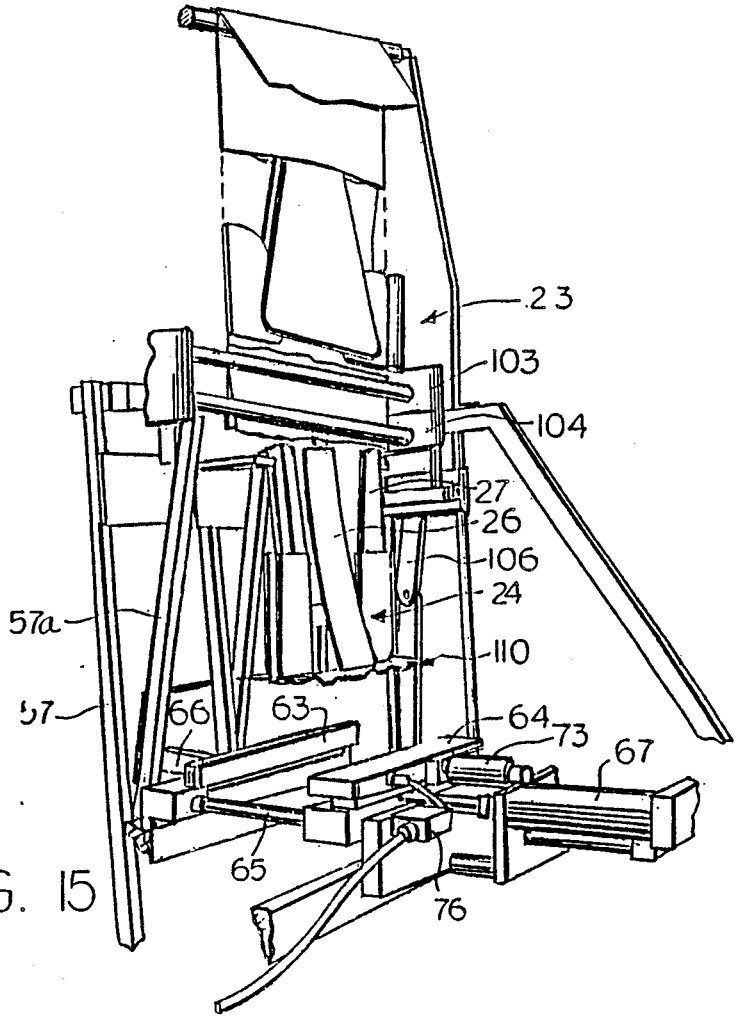
FIG. 15 is a vertical perspective of the bag forming assemblies and heater-cutter mechanism employed in the apparatus of FIG. 14.
Figure 16:
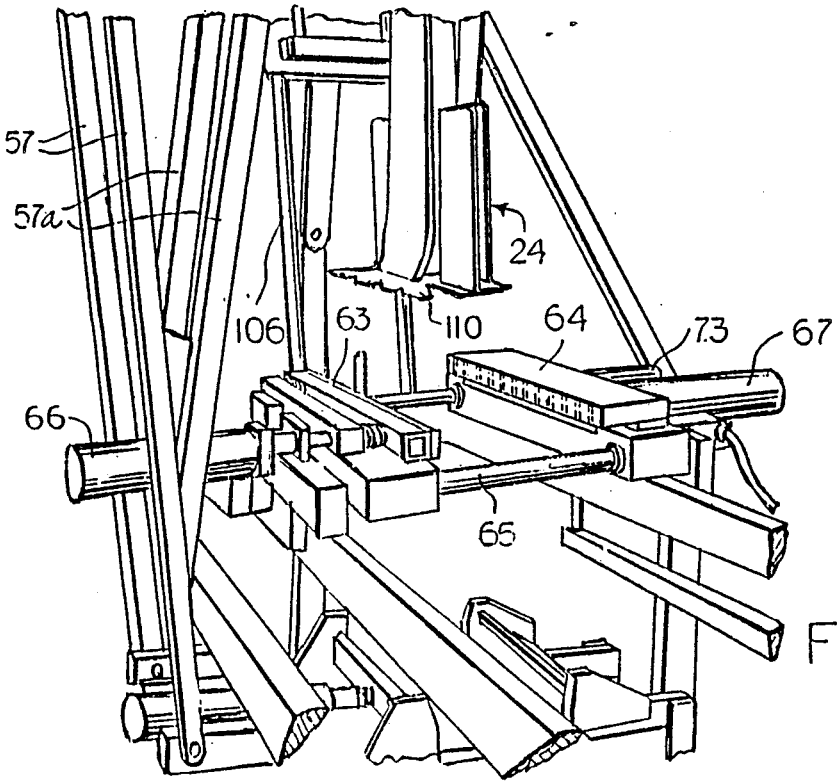
FIG. 16 is an enlarged view downwardly into the apparatus showing the detail of FIG. 15.

Another difference seen in FIG. 14, as well as in FIGS. 15 and 16, is in the shape of the flairing plate of the lower mandrel assembly which is shown here as an elongated member 110.

Figure 17:
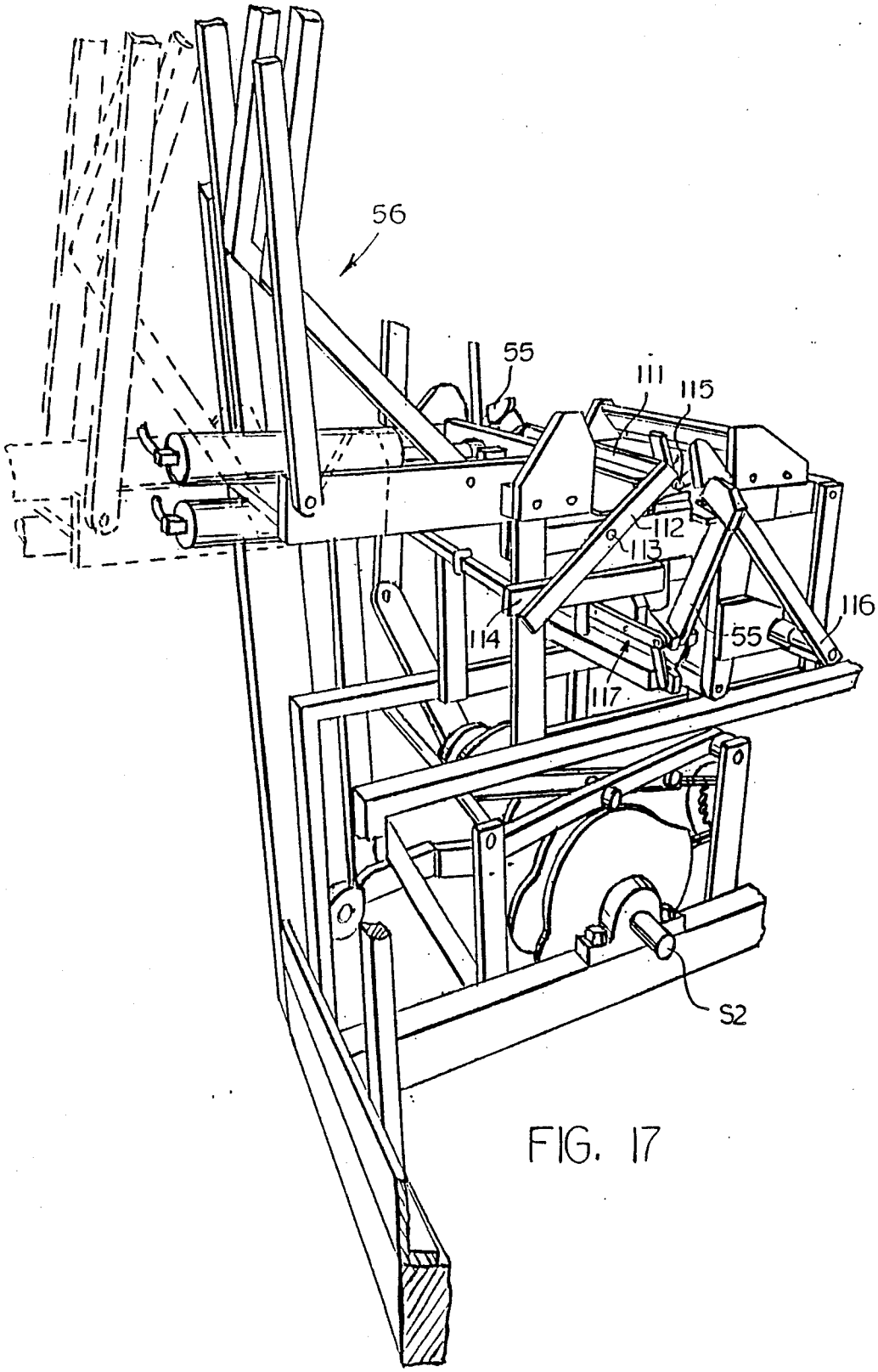
FIG. 17 is an enlarged view of the lower portion of the apparatus of FIG. 14.

Turning to FIG. 17, additional detail is shown with regard to the platform 52 and the clamping members for holding the bag in place, allowing the lower mandrel assembly to be raised, before the ejector assembly removes the bag. Here, a transversely extending arm 11 fixed at each end to a pivoted arm 112, is mounted on the side of the platform 52 adjacent the ejector assembly 56. The arm 112 is pivoted at its centre 113 and fixed to a horizontal strip 114 which is connected to a vertical rod riding on a cam connected to the drive cam C described earlier so that as the horizontal strip 114 is raised and lowered, arm 112 is swung toward or away from the platform 52. The rod 111 is thus caused to clamp and release the bag bottom to the platform, functioning as the clamp 55*a* shown in FIG. 2, which it can easily replace, if desired. On the opposite side of the platform, there is similarly mounted an elongated transverse roller 115 on a pair of end arms 116 articulately connected to follow another cam connected to the drive cam, in a conventional manner. The clamp arm 111 is held against the bag until such time as the ejector assembly 115 grasps the bag as previously described and pulls the bag causing the bag to fall on to the platform 52 being pulled beneath the clamp arm 111. Once this being to occur, the arm 111 raises slightly and the roller 115 is caused to swing onto the fallen bag exerting sufficient roller pressure to flatten the entire bag, as it is being pulled. Once the bag is removed from the platform 52, the arm 111 and roller 115 are withdrawn, preparing the platform for receipt of the next bag in the cycle.

As seen also in FIG. 17, the gussett fingers 55 are articulately connected to a scissor-like linkage 117 operated also by connection to a cam so that it will, in the necessary timed sequence of operation, cause the tucking inward of the gusset and its hold down during formation of the side seams 54 prior to the removal of the lower mandrel 24.

Each of modifications and elements shown in FIGS. 14–17 could be equally adopted and used in the embodiment of FIGS. 1–13 replacing or augmenting the similarly functioning elements.

Various modifications, changes, and embodiments have been disclosed, and others will be apparent to those skilled in the art. Accordingly, it is intended that the disclosure be taken as illustrative and not limiting of the scope of the invention.

What is claimed is:

1. In a machine for making and folding open top flat bottom bags from a heat sealable material, means on said machine supplying a continuous length of heat sealable material including means for feeding said material leading end first over a bag forming means, sealing means operable, on passing of said leading end and beyond said bag forming means, to form a closure seal at the leading end of said material, said bag forming means being operable to expand said material to form in the material opposed faces and opposed sides and a flat bottom for a bag including said opposed faces and sides, material severing means operable to sever at a distance spaced from the leading end a length of said material to form the open top of the flat bottom bag and to form a closure seal for the next succeeding bag, folding means operable in cooperation with said bag forming means to seal portions of the opposed sides to the flat bottom of the bag and to remove the severed length of material from said bag forming means while folding the flat bottom of the bag alongside at least a portion of the material severed, and means selectively controlling the sequence of operations of said bag forming means, folding means, sealing means and severing means.

2. In a machine as in claim 1, said bag forming means and folding means including means cooperable to engage the flat bottom of the bag to flatten the same therebetween and to seal portions of the sides of the bag to the flat bottom of the bag.

3. In a machine as in claim 1, and means on said folding means to gusset the opposed sides of the heat sealable material.

4. In a machine as in claim 1, said bag forming means and folding means including means cooperating to flatten between them the gussets of the opposed sides to form gusset flaps and to seal the gusset flaps to the flat bottom of the bag.

5. In a machine as in claim 1, said folding means and forming means being movable on said machine toward each other to flatten and seal the opposed sides to the flat bottom of the bag and being movable on said machine away from each other, said folding means including means to engage the flat bottom of the bag to remove the severed length of the material from said bag forming means during the movement of said folding and forming means away from each other.

6. In a machine as in claim 1, the continuous length of the heat sealable material being a sleeve enclosing said bag forming means, said sealing means being operable to form the closure seal on the material to enclose said bag forming means therein, and said bag forming means forming the flat bottom of the bag with the closure seal included as a part thereof.

7. In a machine as in claim 6, said bag forming means including means to gusset the opposed sides of the sleeve of material, said folding means including means to fold said gussetted sides to form gusset flaps against the flat bottom of the bag, and said folding and bag forming means including means to seal the gussetted flaps to the flat bottom of the bag.

8. In a machine as in claim 7, and means on said folding means to remove the severed length of the sleeve material from the bag forming means.

9. In a machine as in claim 8, said sleeve material removing means including cooperating rollers engaging the flat bottom of the bag therebetween.

10. In a machine as in claim 8, said folding means including means to crease one of the opposed faces of the sleeve material and to fold the flat bottom of the bag along the crease and against the one opposed face of the sleeve material.

11. In a machine for making flat bottom bags from a substantially endless sleeve of sealable material having opposed faces and opposed gussetted sides, seal means for forming a transverse seal to seal together the opposed faces and for including the gussetted sides in said transverse seal, a forming assembly on said machine including means interior of the transversely sealed sleeve having opposed faces operable from an inactive to an active position for opening the gussetted sides and for forming a flat bottom for a bag in which the gussetted sides form interior flaps to be sealed to the flat bottom of the bag, said forming assembly having seal means exterior of the sleeve cooperating with said interior means between its active and inactive positions, a folding assembly on said machine movable toward said forming assembly and having seal means cooperable with said interior means for sealing the gusset flaps to the flat bottom of the bag in a plane perpendicular to said opposed faces, and for thereafter folding the flat bottom of the bag against one of the faces of the bag parallel to the plane thereof, and means for severing the thus formed flat bag from the remainder of the length of the sleeve of the bag, and discharging said thus formed bag.

12. In a machine as in claim 11, said folding means and feeding means cooperable to grip and flatten the bottom of the bag between them before folding the bag and before said interior means is operated to its inactive position.

13. In a machine as in claim 12, said folding means including means for creasing one face of the bag along which the flat bottom of the bag is folded.

14. In a machine as in claim 11, said folding assembly having a planar member cooperable with said interior means to clamp flat the flat bottom of the bag, said gussetted flap sealing means being on said planar member for cooperation with said interior means.

15. In a machine as in claim 14, said folding means and feeding means clamping said interior means between said planar member while flattening the bag bottom and sealing the gussetted flap, and said interior means being removable from its clamped position to its inactive position as said folding assembly moves away from said forming assembly.

16. A method of forming a flat bottom bag of a sealable material comprising moving a continuous sleeve of the bag material and a bag forming assembly relative to each other, sealing the sleeve to enclose the bag forming assembly therein, operating the bag forming assembly to open the sleeve to form bag walls and a flat bottom for the bag including the seal, folding the flat bottom of the bag, cutting the sleeve to separate the folded flat bottom bag from the remainder of the sleeve, and removing the cut flat bottom bag from the bag forming assembly while folding the bag.

17. The method as in claim 16, moving the bag forming assembly and the enclosing sealed sleeve together toward a bag folder while moving the bag folder toward the bag forming assembly and sleeve, and sealing between the bag folder and bag forming assembly certain of the bag walls to the flat bottom of the bag.

18. A machine as in claim 17, engaging the flat bottom bag by the bag folder and removing the cut flat bottom bag from the bag forming assembly by moving the bag folder and the bag former assembly away from each other.

19. A machine as in claim 18, folding the flat bottom of the bag against one of its walls.

20. A machine as in claim 17, cutting the folded flat bottom bag from the remainder of the sleeve after the sleeve is sealed to enclose the bag forming assembly therein.

21. The method as in claim 16, moving the continuous sleeve of bag forming material and the forming assembly relative to each other to position the sleeve about the bag forming assembly preparatory for forming another bag.

22. A machine as in claim 21, sealing the sleeve to enclose the bag forming assembly therein for forming another bag.

23. A machine as in claim 16, sealing the sleeve to enclose the bag forming assembly and cutting the sleeve to separate the folded flat bottom bag from the sleeve at substantially the same time.

* * * * *